US007690782B2

(12) United States Patent
Odell

(10) Patent No.: US 7,690,782 B2
(45) Date of Patent: Apr. 6, 2010

(54) APPARATUS AND PROCESS FOR PRINTING ULTRAVIOLET CURABLE INKS

(75) Inventor: Peter Gordon Odell, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 160 days.

(21) Appl. No.: 11/005,991

(22) Filed: Dec. 7, 2004

(65) Prior Publication Data

US 2006/0119686 A1 Jun. 8, 2006

(51) Int. Cl.
*B41J 2/01* (2006.01)

(52) U.S. Cl. ..... 347/102; 347/101

(58) Field of Classification Search ..... 347/102, 347/101

See application file for complete search history.

(56) References Cited

U.S. PATENT DOCUMENTS 6,536,889 B1 3/2003 Biegelsen et al.
6,550,905 B1 * 4/2003 Deckers ..... 347/102
6,561,640 B1 5/2003 Young
6,683,421 B1 1/2004 Kennedy et al.
6,786,589 B2 * 9/2004 Suzuki et al. ..... 347/102
2004/0080598 A1 4/2004 Hasebe et al.
2004/0119772 A1 * 6/2004 Hoshino et al. ..... 347/102
2004/0135159 A1 7/2004 Siegel
2004/0164325 A1 8/2004 Siegel
2004/0166249 A1 * 8/2004 Siegel ..... 427/558

* cited by examiner

*Primary Examiner*—Manish S Shah
(74) *Attorney, Agent, or Firm*—Fay Sharpe LLP

(57) ABSTRACT

An apparatus and process for curing UV-curable inks having multiple printhead ejectors and ultraviolet light emitting diodes (UV-LEDs). The printhead ejectors are placed on the assembly in a geometry corresponding to the UV-LEDs such that when a printhead ejector deposits an ink droplet upon a substrate moving relative to the assembly, at least one UV-LED can pass directly over the ink droplet.

12 Claims, 7 Drawing Sheets

APPARATUS AND PROCESS FOR PRINTING ULTRAVIOLET CURABLE INKS

BACKGROUND

Illustrated herein, in various embodiments, is an assembly for use with ultraviolet curable inks wherein curing is performed using ultraviolet light emitting diodes (UV-LEDs). In particular, one or more UV-LEDs are placed in a geometry corresponding to one or more individual printhead ejectors upon the assembly such that when a printhead ejector deposits an ink droplet upon a substrate, at least one UV-LED will subsequently pass directly over the droplet. A process for printing utilizing such an assembly is also disclosed herein in various embodiments.

A relatively new printing technology exists that increases printing speed with fast controllable drying, ultraviolet (UV) photosensitive resin-containing substances. Fast drying substances containing ultraviolet photosensitive resins work well with direct marking print technology near room temperature. As used here, the term "ultraviolet" encompasses the range of wavelengths of light from about 50 nanometers to about 500 nanometers.

Ultraviolet photosensitive inks may be used in inkjet printers. Two main inkjet technologies are currently generally used. In a "bubble jet" or thermal inkjet (TIJ) printer, each printhead ejector comprises a reservoir, a heating element, and a nozzle. When the heating element heats up, some of the ink is vaporized to create a bubble within the reservoir. As the bubble expands, an ink droplet is pushed out of the nozzle. When the bubble collapses, a vacuum is created which pulls ink into the reservoir from the ink cartridge. TIJ printers typically use inks in a solvent (such as water) having a low viscosity of about 2 centipoises (cPs).

In a piezoelectric inkjet (PIJ) printer, each printhead ejector comprises a piezoelectric crystal at one end, a nozzle at the other end, and a reservoir between them. When an electric current is applied to the crystal, it vibrates. As the crystal vibrates inward (into the reservoir), an ink droplet is pushed out of the nozzle. When the crystal vibrates outward, a vacuum is created which pulls ink into the reservoir from the ink cartridge. The ink used in a PIJ printer typically has a viscosity of about 10 to 12 cPs. In both cases, the ink droplets form the image to be printed.

Another type of drop-on-demand system is known as acoustic ink printing (AIP). As is known, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension.

Because a PIJ printer operates at a higher viscosity range, a solvent-free UV-curable ink formulation can be used. This means that there are no VOC (volatile organic compound) emissions; the lack of emissions and durability are the major attractive features of UV-curable inks. Such formulations are known to those skilled in the art and can be manufactured using photoinitiators and mixtures of curable monomers and oligomers. Suitable photoinitiators may be selected from a wide variety of compounds that respond to light through production of free radicals; alternatively photoinitiators may be selected from a variety of compounds that respond to light through production of Bronsted or Lewis acids. When free radical photoinitiators are employed the typical polymerizable groups on the monomer may be acrylates or methacrylates. When strong acid or cationic photoinitiators are used the typical polymerizable groups are epoxides and vinyl ethers.

In a printer using UV-curable inks, the UV light source has traditionally been a mercury vapor lamp. Recently, there has been a trend towards using UV light emitting diodes (UV-LEDs). UV-LEDs offer several advantages over mercury vapor lamps. They can be turned on and used instantly ("instant-on"), whereas medium pressure mercury vapor lamps typically require many minutes to stabilize before they can be used. Microwave excited or electrodeless mercury vapor lamps may require several seconds to switch on and off. UV LEDs also produce less heat, do not produce byproducts such as ozone, and have a longer operating life. In addition, they produce a narrow distribution of wavelengths (±10-15 nanometers), leading to a highly energy-efficient cure. Because the distribution of wavelengths is narrow, a UV-LED can also be used to selectively cure mixtures containing multiple photoinitiators (P is) which respond to different wavelengths. UV-LEDs are also smaller and potentially cheaper, which allow them to be placed and used in locations not previously suitable for a large mercury vapor lamp systems.

Additionally, mercury lamps and xenon light sources flood the curing target with light and are not digitally addressable. UV LEDs as configured in this disclosure on the other hand can be digitally addressed; the light source can be turned on and off to illuminate only the deposited ink pixel and not illuminate areas where no ink has been placed. If no ink drop has been fired at a particular time from a particular ink jet orifice, the corresponding LED(s) need not be fired. In this fashion significant energy savings may be realized, a document that has only 10% area coverage would need only 10% of the light that complete 100% coverage would require. This process is digital curing, it is readily accomplished as the digital code has already been created for controlling the printhead and can be extended to command the firing of the corresponding LEDs.

Furthermore, with direct marking print technologies, such as inkjet applications, drop diameter spread control directly impacts the quality of print image resolution. To minimize lateral ink spread, the drop diameter needs to be controlled and minimized, generally by using various ink delivery technologies. One method to minimize ink spread is to cure the ink as quickly as possible after delivery by increasing its viscosity. In printers where an intermediate transfer surface, such as a transfuse drum, is used before transferring a UV-curable ink to a final substrate such as paper, the ink may be partially cured on the intermediate transfer surface before it is transferred to the final substrate and cured again. For example, the ink may begin with a viscosity around 10 cPs within the ink cartridge; after being deposited onto the intermediate transfer surface, it is partially cured to a transfuse viscosity of between $10^4$ and $10^9$ cPs. This ensures a stable image during drum rotation and effective transfer to paper. After it is transferred to the final substrate, it is completely cured to an almost infinite viscosity.

In an inkjet printer which uses a transfuse drum, the image is usually built up on the drum over several rotations of the drum. If the transfuse drum rotates along the y-axis and the axis of the transfuse drum defines the x-axis, then the printhead deposits a set of ink drops onto the drum as the drum rotates along the y-axis. The printhead then moves along the x-axis to a new location along the drum where it deposits another set of ink drops during the next rotation. This rotate-and-translate scheme reduces the complexity and cost of the printhead by reducing the number of printhead ejectors required to print the image. Similarly, it reduces the cost and complexity of the LED array, fewer LED elements or dies are required and they can be more widely spaced. It also reduces the number of print defects in the final image; if one printhead ejector fails to deposit an ink drop, the failure can be detected and masked by other ejectors passing over the same spot. The number of rotations and corresponding printhead translations required to produce an image can vary; for example, it can range from 4 to 22 rotations.

As mentioned above, one method to minimize ink spread and provide a defect-free image is to cure the ink as quickly as possible after delivery by increasing its viscosity. For UV-curable inks, ideally this means placing the UV light source as close to the printhead ejector as possible; this reduces the time during which the low-viscosity ink can spread.

It is therefore desirable to provide an apparatus for inkjet printers which provides direct UV light energy for partially or completely curing UV-curable inks in a minimum amount of time after the ink has been deposited.

BRIEF DESCRIPTION

Disclosed herein in various embodiments is an inkjet printing assembly in which UV light is provided immediately after a UV-curable ink has been deposited. In particular, the assembly comprises one or more printhead ejectors placed in a geometry corresponding to one or more UV-LEDs such that when a printhead ejector deposits an ink droplet upon a substrate moving relative to the printhead, at least one UV-LED subsequently passes directly over the ink droplet. The UV-LEDs are placed on the assembly itself and are preferably digitally addressable.

In another embodiment, the assembly comprises a printhead and a separate assembly of UV-LEDs. One or more UV-LEDs on the separate assembly are placed in a geometry corresponding to one or more printhead ejectors on the printhead as described above.

In a further embodiment, a printing array assembly is provided having a plurality of printhead ejectors and a plurality of UV-LEDs in at least one operative orientation. In this regard, each printhead ejector is located on the assembly in a geometry corresponding to at least one UV-LED such that when the printhead head ejector deposits an ink droplet upon a substrate moving relative to the assembly and the assembly is in an operative orientation, at least one of the UV-LEDs subsequently passes over the ink droplet. In related embodiments, the UV-LEDs are digitally addressable.

In an additional embodiment, an apparatus and process for curing UV-curable inks is provided comprising multiple printhead ejectors and ultraviolet light emitting diodes (UV-LEDs). The printhead ejectors are placed on the assembly in a geometry corresponding to the UV-LEDs such that when a printhead ejector deposits an ink droplet upon a substrate moving relative to the assembly, at least one UV-LED can pass directly over the ink droplet. Optionally, the printhead injectors and/or UV-LEDs are positioned in an oxygen free zone to enhance curing of the UV-curable inks.

In still another embodiment, a process for printing UV-curable inks is disclosed. The process comprises providing an assembly having one or more printhead ejectors which are arranged in a geometry with one or more ultraviolet light emitting diodes such that when each printhead ejector deposits an ultraviolet curable ink droplet upon a substrate at least one of the ultraviolet light emitting diodes will subsequently pass over the droplet. Also included in the process is activating the assembly to deposit an ultraviolet curable ink deposit upon a substrate and then illuminating the ultraviolet light emitting diodes as they pass over the droplet to cure the ink.

In a still further embodiment, a process is provided for printing wherein an assembly is provided having one or more printhead ejectors which are arranged in a geometry with one or more ultraviolet light emitting diodes in an oxygen-free zone such that when the printhead ejector deposits an ultraviolet curable ink droplet upon a substrate, at least one of the ultraviolet light emitting diodes will subsequently pass over the droplet. This process also comprises activating the assembly to deposit an ultraviolet curable ink droplet upon a substrate and then directly exposing the droplet to ultraviolet light in an oxygen-free zone as the ultraviolet light emitting diodes pass over the droplet.

These and other non-limiting aspects of the exemplary embodiments disclosed herein are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
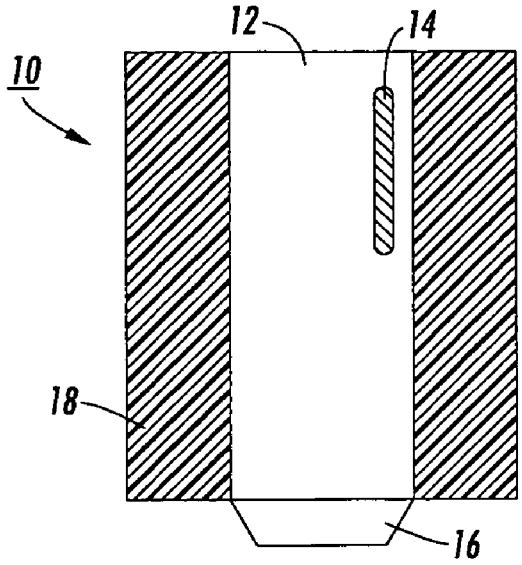
FIG. 1 is a general diagram of a printhead ejector for a TIJ printer.

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the printing assemblies or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Referring initially to FIG. 1, there is generally shown the internal workings of a TIJ printhead ejector. The ejector 10 comprises a casing 18 defining a reservoir 12 containing ink. A heating element 14 is also located within the reservoir 12. A nozzle 16 allows the ink to be printed onto a substrate, such as paper. The TIJ printhead ejector 10 prints by heating the heating element 14. This vaporizes some solvent in the ink present in the reservoir 12, causing a bubble to form. As the bubble expands, an ink droplet is pushed out of the nozzle 16. When the bubble collapses, a vacuum is created, which pulls more ink into the reservoir from the ink cartridge (not shown).

Figure 2:
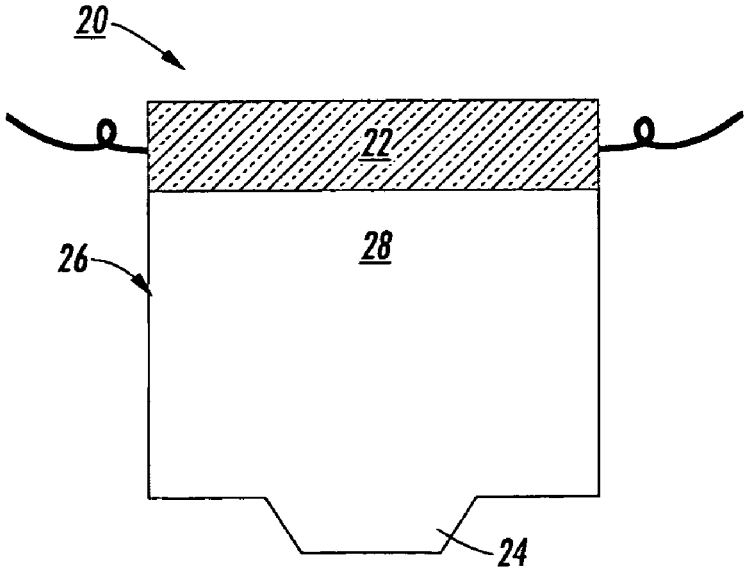
FIG. 2 is a general diagram of a printhead ejector for a PIJ printer.

FIG. 2 shows generally the internal workings of a PIJ printhead ejector. The ejector 20 comprises a casing 26 defining a reservoir 28 containing ink. One part of the reservoir comprises a piezoelectric crystal 22 and another part comprises the nozzle 24. The PIJ ejector 20 prints by passing an electric current through the piezoelectric crystal, which causes the crystal to vibrate. When the crystal vibrates into the reservoir, an ink droplet is pushed out of the nozzle 24. When the crystal vibrates out from the reservoir, a vacuum is created which pulls ink into the reservoir from the ink cartridge (not shown).

Because TIJ typically operates at a lower viscosity than PIJ, PIJ is most often used for UV-curable inks because no solvent is needed. However, it is possible to formulate an ink that uses soluble UV-curable monomers and oligomers that are cured during or after the evaporation of the solvent subsequent to printing. The embodiments disclosed herein may be used in either TIJ or PIJ printers.

In each of the embodiments disclosed herein, one or more printhead ejectors are placed in a geometry corresponding to one or more UV-LEDs such that when an ink droplet is deposited by a printhead ejector, at least one UV-LED corresponding to that printhead ejector subsequently passes directly over the ink droplet. Arranging the UV-LEDs and printhead ejectors in this geometry effectively provides digital curing of the digital image produced by the printhead. This assembly compares well against a typical UV curing system wherein the UV light source is separate from the printhead and the entire width of the substrate is exposed to UV light, especially in a printer using a transfuse drum. In a rotate-and-translate scheme, the drum rotates several times during printing. If, for example, the drum rotates 4 times during printing, then in a typical UV curing system the first set of ink droplets deposited on the drum is directly exposed to UV light 4 times whereas the last set of ink droplets deposited on the drum is directly exposed only once. The result is that the partial cure of the droplets is very different across the range of exposures; in this example 4 different rheologies are created. Equally transferring these rheologies to a final substrate is practically impossible to do without affecting print quality, even with only 4 different rheologies.

However, in the embodiments disclosed herein, each ink droplet is printed, directly exposed to UV light by a UV-LED corresponding to the printhead ejector it originated from, and then does not experience direct exposure again during the partial cure. This direct exposure of each ink droplet also provides better partial curing compared to an indirect exposure to UV light because the cure is more uniform across the entire print. The effective range of a UV-LED is not large, so indirect exposure does not cure as well.

In addition, in certain embodiments each UV-LED can be individually addressable. Consequently, if a corresponding printhead ejector does not release a droplet, the UV-LED does not turn on to cure the location that printhead ejector would have printed on.

With respect to the timing of the UV-LED illumination, it has been found that the exposure time for an individual ink pixel can be estimated for an exemplary system. The ink pixel diameter is about 68 microns, this the approximate size produced by a 350 dpi (dot per inch) resolution printer, the individual LED illuminating is about 300 microns wide, approximately the size of an individual illuminating element in an LED array obtained from EXFO Photonic Solutions Inc., the drum is 10 cm in diameter rotating at 180 rpm to produce a linear surface speed of 9.4 m/s. Thus the 68 micron ink pixel passes by the 300 micron LED element at 9.4 m/s. It is understood that the size of the ink pixel, the LED element and the drum or substrate speed may change among different printer designs. In this example the pixel may be illuminated when directly under the LED in which case the illumination period is $3.2\times10^{-5}$ s, or the LED can be illuminated in anticipation of the ink pixel, for example, the light may spread to twice the actual diameter of the LED element itself to 600 microns, in which case the illumination period for an individual pixel is about $6.4\times10^{-5}$ S. Other approximations of the effective light spread may be made. Similarly, from these exemplary dimensions the timing of the LED illumination is the distance between the printhead ejector and its corresponding LED element divided by the substrate speed. For example if that distance is 1 cm the LED should be illuminated about $1.06\times10^{-3}$ s after drop ejection.

Moreover, in other embodiments, the printhead ejectors and/or UV-LEDs are positioned on the array in an oxygen-free environment to enhance curing of the UV-curable inks. In this regard, several radical curing inks are sensitive to oxygen during curing under LED light. This is minimized by creating an oxygen-free zone in the printing area. For example, this can be overcome by inerting the curing area with nitrogen, etc. These and other embodiments will be discussed in more detail below.

In the following figures, a printhead ejector will generally be represented by a circle and a UV-LED will generally be represented by a triangle. It is also assumed that there is a substrate moving relative to the depicted assemblies.

Figure 3:
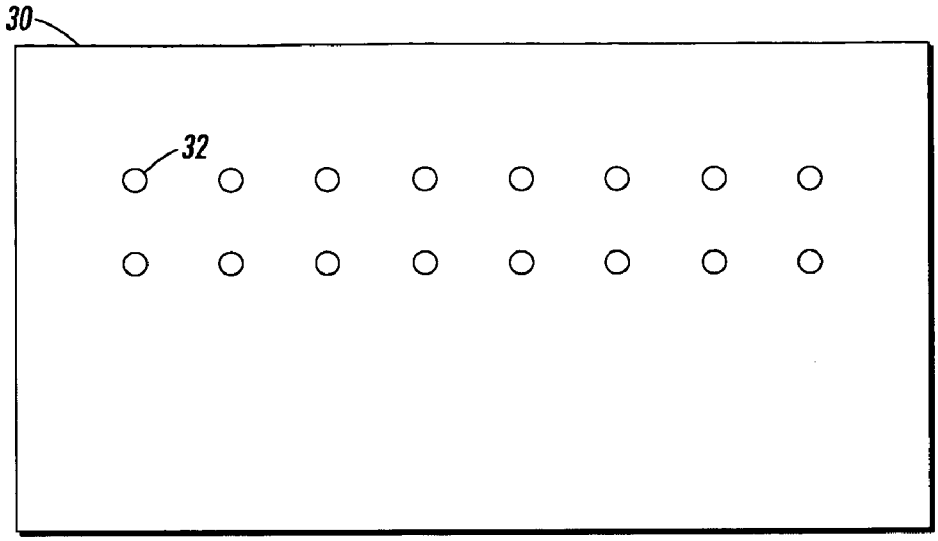
FIG. 3 is a representative diagram of a conventional printhead.

FIG. 3 is a diagram of an exemplary printhead 30. Located on the printhead are multiple printhead ejectors 32. Here, the printhead ejectors are arranged in a 2×8 array. However, this should not be construed as limiting the number, location, or orientation of the printhead ejectors. For example, printheads normally comprise several hundred ejectors. Printheads are usually spaced evenly. For example, there is about 2.4 mm between each ejector on a Xerox Model 340 printhead and about 0.7 mm between ejectors on a Xerox Model 8400 printhead.

Figure 4:
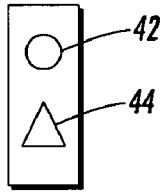
FIG. 4 is a general diagram of a single printhead ejector and one UV-LED.

FIG. 4 is a general diagram showing the relationship in one embodiment between a printhead ejector and a UV-LED. Here, the printhead ejector 42 is located relative to the UV-LED 44 so that as the printhead ejector deposits an ink droplet on a substrate, the UV-LED can subsequently pass directly over the ink droplet. In this embodiment, each UV-LED corresponds to a specific printhead ejector; i.e., the ratio of printhead ejectors to UV-LED is 1:1.

Figure 5:
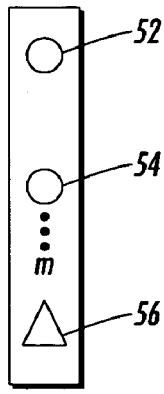
FIG. 5 is a general diagram of multiple printhead ejectors and one UV-LED.

In FIG. 5, there is shown another embodiment wherein two printhead ejectors 52 and 54 are located relative to a UV-LED 56 so that as each printhead ejector deposits an ink droplet on a substrate, the UV-LED can subsequently pass directly over the ink droplet deposited by each printhead ejector. While two printhead ejectors are shown in this figure, it is contemplated that there may be up to m printhead ejectors corresponding to one UV-LED. Here, the ratio of printhead ejectors to UV-LEDs is m:1. This diagram should not be construed as limiting the location of the printhead ejectors and the UV-LED relative to each other.

Figure 6:
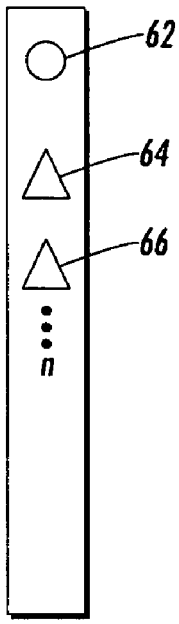
FIG. 6 is a general diagram of a single printhead ejector and multiple UV-LEDs.

In FIG. 6, there is a printhead ejector 62 located relative to two UV-LEDs 64 and 66 so that as the printhead ejector deposits an ink droplet on a substrate, at least one of the UV-LEDs can pass directly over the ink droplet. While two UV-LEDs are shown in this figure, it is contemplated that there may be up to n UV-LEDs corresponding to each printhead ejector. Here, the ratio of printhead ejectors to UV-LEDs is 1:n. This diagram should not be construed as limiting the location of the printhead ejectors and the UV-LED relative to each other. Additionally, FIGS. 4-6 should not be construed as requiring the printhead ejector and UV-LED to be located on the same element of the assembly.

Figure 7:
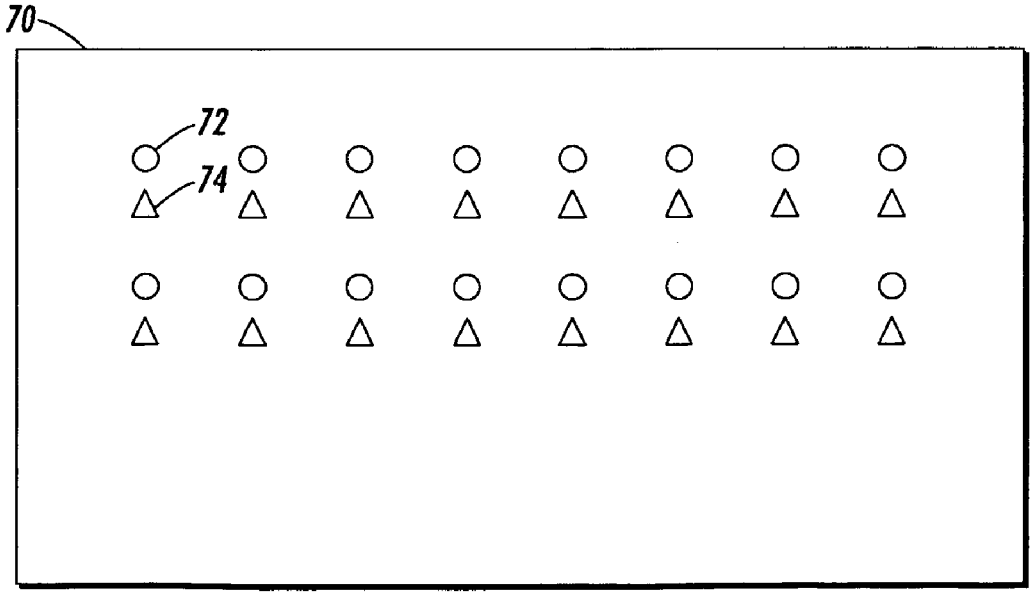
FIG. 7 is an embodiment of an array assembly according to the present disclosure.

FIG. 7 is an exemplary embodiment of an array assembly 70 according to the present invention. Located on the assembly are multiple printhead ejectors and multiple UV-LEDs. In this embodiment, each printhead ejector 72 has a corresponding UV-LED 74. A UV-LED is located relative to a printhead ejector so that as the printhead ejector deposits an ink droplet on a substrate, the UV-LED can subsequently pass directly over the ink droplet. As previously mentioned, there can be as little as about 0.7 mm between ejectors on a Xerox Model 8400 printhead. Experimental high-output LEDs have been obtained from EXFO Photonic Solutions Inc. which have the shape of a square measuring about 0.3 mm on each side. Thus, it is possible to locate at least one UV-LED in the space between ejectors and still allow space for other elements. In addition, the printhead is usually maintained at a constant temperature so the ink viscosity remains constant and ensures reliable defect-free printing. In an office setting, the printhead usually needs a minimum temperature of about 40° C. In other embodiments, the UV-LED could also act as a heater for the printhead while the printhead acts as a heat sink for the UV-LED, thus more efficiently using power. In those embodiments, other temperature control means, not depicted here, would also be used.

Figure 8:
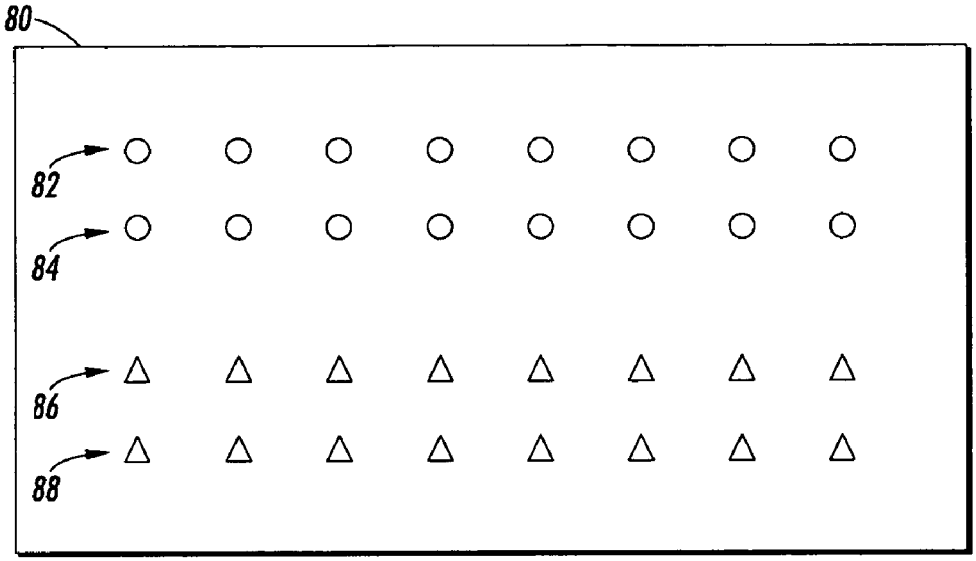
FIG. 8 is another embodiment of an array assembly according to the present development.

FIG. 8 is another exemplary embodiment of an array assembly 80 according to the present disclosure. Again, multiple printhead ejectors and multiple UV-LEDs are located on the assembly. This embodiment differs from that of FIG. 7 only in the relative location of the printhead ejectors and UV-LEDs; the 1:1 ratio of printhead ejectors to UV-LEDs still exists. Here, printhead ejector 82 corresponds to UV-LED 86 and printhead ejector 84 corresponds to UV-LED 88.

Figure 9:
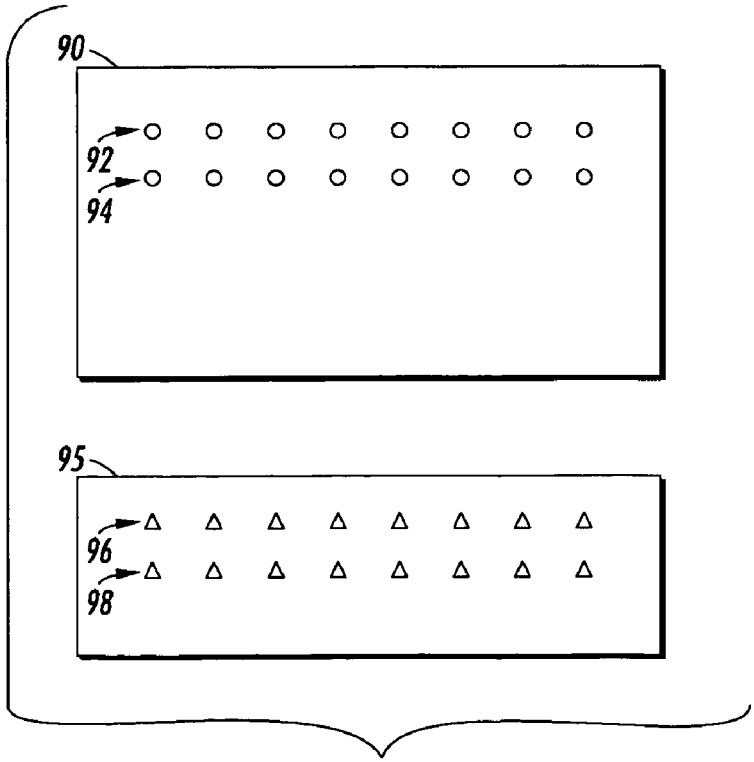
FIG. 9 is a further embodiment of an array assembly according to the present disclosure.

FIG. 9 is a further exemplary embodiment according to the present disclosure. Here, the printhead ejectors and UV-LEDs are located on separate elements of the assembly. The printhead ejectors 92 and 94 are located on a first element 90 and the UV-LEDs 96 and 98 are located on a second element 95. Again, the embodiment differs only in the relative location of the printhead ejectors and UV-LEDs; the 1:1 ratio of printhead ejectors to UV-LEDs still exists. Printhead ejector 92 corresponds to UV-LED 96 and printhead ejector 94 corresponds to UV-LED 98. The first element 90 and the second element 95 are placed in a geometry such that as a printhead ejector deposits an ink droplet on a substrate, its corresponding UV-LED can subsequently pass directly over the ink droplet. For example, the first element and second element may be rigidly interconnected.

Figure 10:
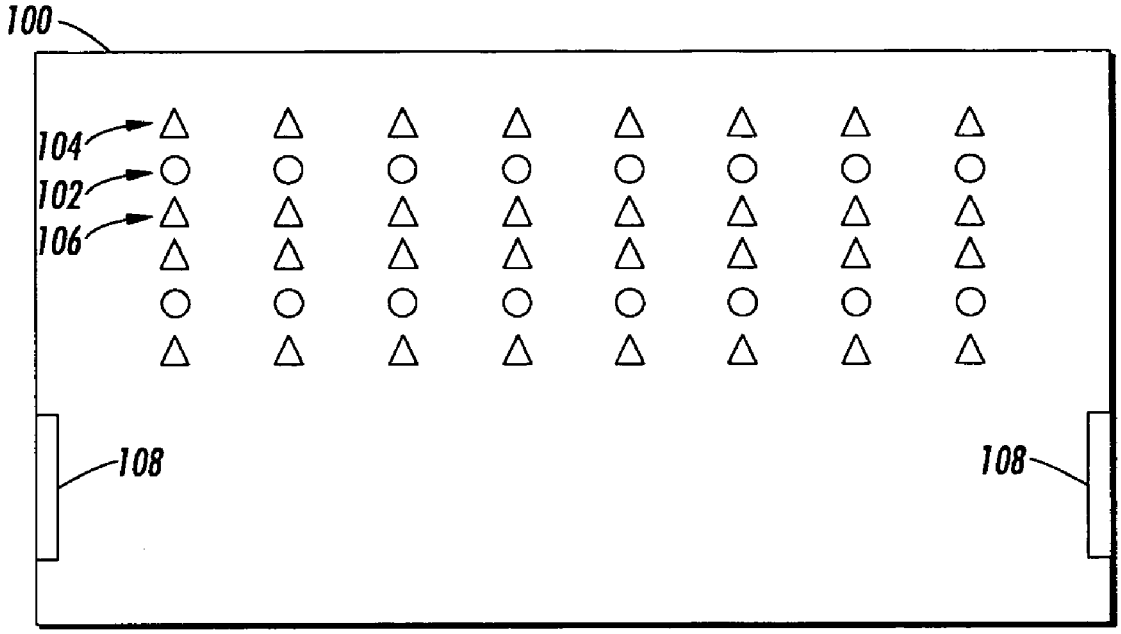
FIG. 10 is still another embodiment of an array assembly according to the present development.

FIG. 10 is still another exemplary embodiment according to the present disclosure. Multiple printhead ejectors and multiple UV-LEDs are located on an assembly 100. Here, the ratio of printhead ejectors to UV-LEDs is 1:2. UV-LEDs 104 and 106 correspond to printhead ejector 102. In this embodiment, multiple operative printing orientations may exist between the assembly and the substrate it prints onto. For example, the assembly of FIG. 10 has two operative printing orientations. In the first operative orientation, an ink droplet is deposited from ejector 102 and then partially cured by UV-LED 104, which subsequently passes directly over it. In the second operative orientation, an ink droplet is deposited from ejector 102 and then partially cured by UV-LED 106, which subsequently passes directly over it. Means may be provided for directly rotating the assembly, means may be provided so that the assembly may be attached to a carriage which rotates between the operative printing orientations, or the assembly may be adapted to be attached to a carriage; reference numeral 108 is intended to encompass these possibilities. Such operative printing orientations may occur in all three axes. Each UV-LED may also emit light at a different wavelength, though this is not required. This feature may be convenient for UV-curable inks containing multiple P is which respond to different wavelengths and allow for increased flexibility of use. As previously mentioned, there is about 2.4 mm between each ejector on a Xerox Model 340 printhead and a UV-LED measures about 0.5 mm on each side, so it is possible to place two UV-LEDs between each printhead ejector.

Figure 11:
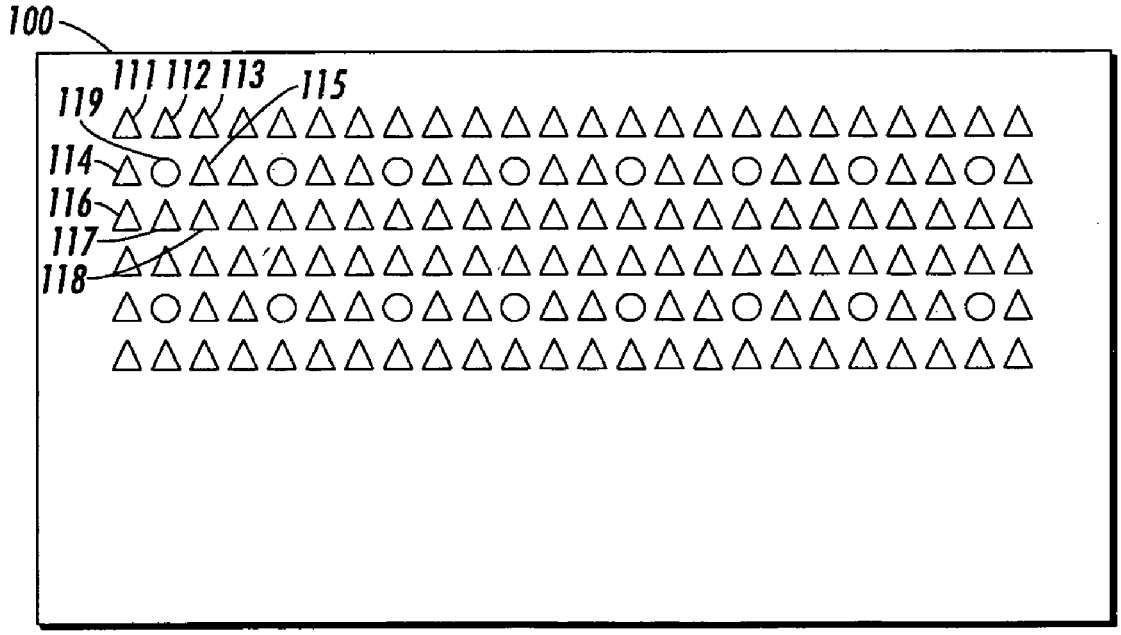
FIG. 11 is a still further embodiment of an array assembly according to the present disclosure.

FIG. 11 is a still further exemplary embodiment according to the present disclosure. Multiple printhead ejectors and multiple UV-LEDs are located on an assembly 110. Here, the ratio of printhead ejectors to UV-LEDs is 1:8. UV-LEDs 111, 112, 113, 114, 115, 116, 117, and 118 correspond to printhead ejector 119. Again, multiple operative printing orientations may exist between the assembly and the substrate it prints onto and means may be provided for rotating the assembly or attaching it to a carriage which rotates between such operative orientations. Other geometries not depicted are also contemplated and considered to fall within the scope of the present disclosure. For example, six UV-LEDs may arrange in a hexagonal pattern around a printhead ejector.

Figure 12:
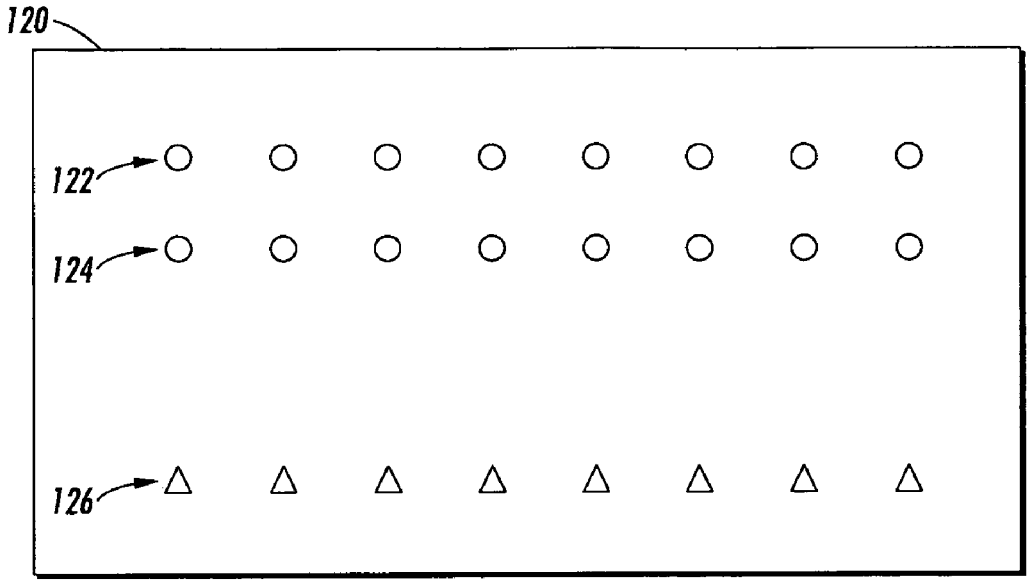
FIG. 12 is a still additional embodiment of an array assembly according to the present development.

FIG. 12 is a still additional exemplary embodiment according to the present disclosure. Multiple printhead ejectors and multiple UV-LEDs are located on an assembly 120. Here, the ratio of printhead ejectors to UV-LEDs is 2:1. Printhead ejectors 122 and 124 correspond to UV-LED 126. In this embodiment, the UV-LED 126 would be timed by appropriate control means (not depicted) to cure an ink droplet released by either or both printhead ejectors. Again, this figure should not be construed as limiting the number, ratio, location, and orientation of printhead ejectors and UV-LEDs.

Figure 13:
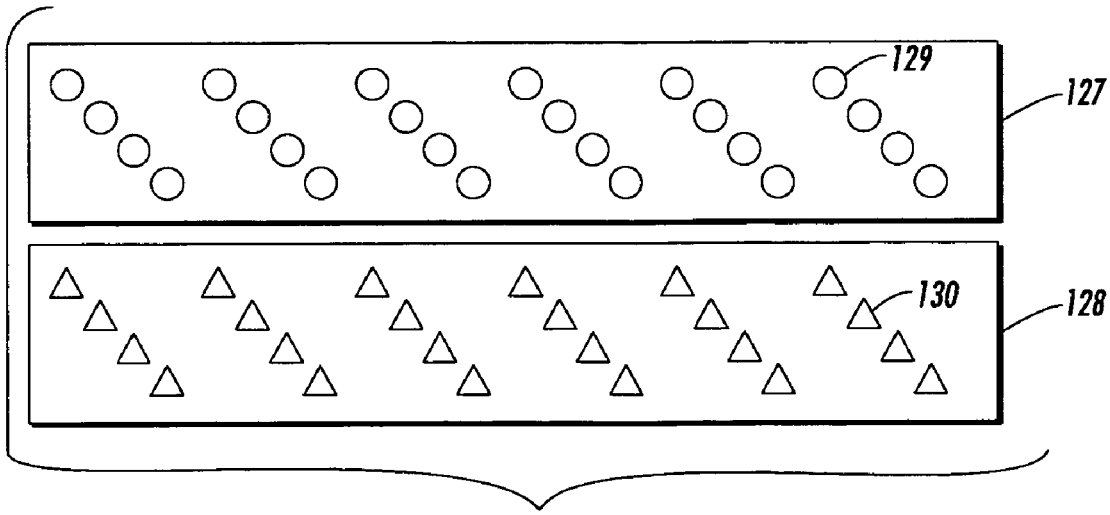
FIG. 13 is a further additional embodiment of an array assembly according to the present disclosure.

FIG. 13 is a still additional exemplary embodiment according to the present disclosure. Multiple printhead ejectors (129) are located on an assembly 127. Multiple UV-LEDs (130) are located on an assembly 128. The diagonal arrangement of the orifices is found in some PIJ and AIP printheads and this figure illustrates how the corresponding LED elements could be arranged.

Figure 14:
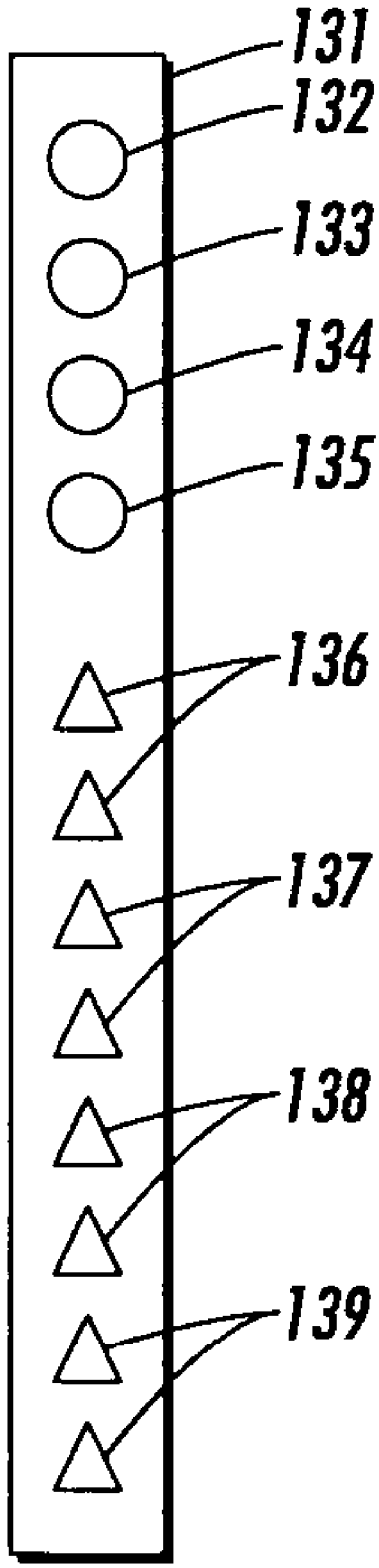
FIG. 14 is yet another embodiment of an array assembly according to the present development.

FIG. 14 is a still further exemplary embodiment according to the present disclosure. Multiple printhead ejectors and multiple UV-LEDs are located on an assembly 131. Here, the ratio of printhead ejectors to UV-LEDs is 1:2. UV-LEDs 136 correspond to printhead ejector 132. UV-LEDs 137 correspond to printhead ejector 132 and so forth. The printhead ejectors each eject a different color ink and the wavelength of the corresponding UV-LEDs is selected independently to provide the most efficient cure for each color.

Although all of the embodiments described herein place UV-LEDs on the assembly or a separate element in order to partially or completely cure a UV-curable ink, they should not be construed as requiring or forbidding other UV light sources within the inkjet printer. For example, if an intermediate transfer surface is used, the embodiments described above would be used to partially cure the UV-curable ink on the intermediate surface and another UV light source would be used to completely cure the ink on the final substrate.

The present exemplary embodiments are further understood in view of the following examples. The examples are intended to illustrate and not limit the scope of the present disclosure.

EXAMPLES

Experimental high output LED arrays were obtained from EXFO Photonic Solutions. Two arrays were tested emitting at wavelengths of 396 nm and 450 nm. The 396 nm device can provide a maximum power of 800 mW/cm2.

An acrylate ink vehicle consisting of 90 parts propoxylated neopentylglycol diacrylate 10 parts tris[2-(acryloyloxy) ethyl] isocyanate containing 4 parts camphorquinone and 8 parts ethyl 4-dimethylamino benzoate as photoinitiators was cured using the 450 nm LED light source. The cure required 5 seconds. This was a good curing time considering the fact that camphorquinone is a slow initiator and the light source at 450 nm did not match its $\lambda_{max}$ of 470 nm. The same formulation did not cure at all when exposed to a 300 W tungsten halogen lamp for five minutes.

A cationic vehicle consisting of 60 parts 1,4-cyclohexane dimethanol divinyl ether, 40 parts limonene dioxide, 0.58 parts isopropyl thioxanthone and 1.78 parts (4-methylphenyl) [4-(2-methylpropyl) phenyl]-hexafluorophasphate(1-) iodonium catalyst was shown to not cure at all with exposure to light from 450 nm emitting LED, but cured in less than 0.1 second with exposure to light from 396 nm emitting LED. Cationic polymerizations are known not to be sensitive to oxygen.

When 20 wt % of the formulation of the acrylate ink vehicle was combined with 80 wt % of the cationic formulation set forth above, a visible thickening of the vehicle occurred at 450 nm and the vehicle was completely hardened at 396 nm.

An ink was formulated using 70 parts propoxylated neopentylglycol diacrylate, 22 parts Ebecryl 812, a polyester acrylate oligomer available from UCB Chemicals, 3 parts phenyl bis (2,4,6-trimethyl benzoyl) phosphine oxide, 3 parts Pigment Black 7, 2.8 parts 1-hydroxycyclohexylphenylketone. The ink was imaged onto a coated paper using a K Printing Proofer (R. K. Print-Coat Instruments Ltd.). Portions of the obtained solid images were exposed to UV light using a 5 mm×5 mm LED Array from EXFO Photonic Solutions that contained 100 LED die elements. The peak maximum output of this device was 396 nm. No discernable evidence of cure could be identified in portions of the ink that were exposed to the LED array at a distance of about 1 mm for up to 20 seconds. The same ink showed pronounced cure when exposed to the same light for 0.1 second when the ink's exposure to oxygen was reduced by placing the ink under a glass slide and a cover slip. After exposure, the coverslip was rinsed with acetone to remove unreacted monomer and oligomer revealing a gray spot about 1.0 cm in diameter. It is well known that oxygen inhibits free radical polymerizations. Levels of photoinitiator higher than the level of oxygen present allows the polymerization to start, but if the rate of oxygen diffusion to the polymerization site is greater than the rate of polymerization the polymerization will stop. The coverslip reduces the rate of oxygen diffusion sufficiently to allow the polymerization to occur.

Alternative means for creating an oxygen-free environment may also be utilized. For example, the sensitivity to oxygen could be overcome by inerting the curing areas with nitrogen, etc.

An ink base was formulated using 72 parts propoxylated neopentylglycol diacrylate, 14 parts Ebecryl 4842, an acrylate urethane oligomer available from UCB Chemicals, 7 parts dipentaerythritol pentacrylate ester, 2 parts isopropyl thioxanthone, 2 parts ethyl 4-dimethylamino benzoate, 3 parts Pigment Blue 15:4, 2 parts 1-hydroxycyclohexylphenylketone. The ink was imaged and exposed to LED light as before with only the slightest indication of cure detected. Curing the ink under a glass coverslip and rinsing with acetone revealed a vivid cyan spot about 1.5 cm in diameter.

An ink base was formulated using 34 parts triethyleneglycol diacrylate, 36 parts propoxylated neopentylglycol diacrylate, 14 parts Ebecryl 812, 7 parts dipentaerythritol pentacrylate ester, 3 parts 2-benzyl-2-(dimethylamino)-1-(4-(4-morpholinyl)phenyl)-1-butanone, 3 parts Pigment Red 212. The ink was imaged and exposed to LED light as before with no indication of cure detected. Curing the ink under a glass coverslip and rinsing with acetone revealed a vivid magenta spot about 1.2 cm in diameter.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A printing array assembly comprising:

a plurality of printhead ejectors;

a plurality of UV-LEDs;

and at least one operative orientation;

wherein each printhead ejector is located on said assembly in a geometry such that when said assembly is in an operative orientation, the printhead ejector corresponds to one UV-LED such that when said printhead ejector deposits an ink droplet upon a substrate moving relative to said assembly, said one UV-LED subsequently passes directly over the ink droplet deposited by the printhead ejector; and wherein said one UV-LED is adapted to illuminate only the ink droplet deposited by the printhead ejector and be extinguished after it passes over the ink droplet; and wherein a ratio of the number of UV-LEDs in said plurality of UV-LEDs to the number of printhead ejectors in said plurality of printhead ejectors is 1.

2. The assembly of claim 1, wherein the assembly is additionally adapted to be attached to a rotating carriage.

3. The assembly of claim 1, wherein said assembly further comprises a first element and a second element; and, wherein said plurality of printhead ejectors are located upon said first element; and, wherein said plurality of UV-LEDs are located upon said second element.

4. The assembly of claim 3, wherein said first element and said second element are rigidly interconnected.

5. The assembly of claim 1, wherein the UV-LED is illuminated when the corresponding printhead ejector has deposited an ink droplet upon the substrate.

6. The assembly of claim 1, wherein the UV-LEDs are located in an oxygen-free zone of an associated printing area for curing of the ink droplet.

7. An array assembly comprising:

a plurality of printhead ejectors; and a plurality of UV-LEDs;

the plurality of printhead ejectors forming a first line, the plurality of UV-LEDs forming a second line parallel to and spaced apart from the first line, and the two lines defining a first axis;

wherein each printhead ejector is located on said assembly in a linear geometry corresponding to a single UV-LED such that when the printhead ejector deposits an ink droplet upon an associated substrate moving along an intersecting axis relative to said assembly, only said UV-LED subsequently passes directly over the ink droplet deposited by the printhead ejector; and wherein said UV-LED is adapted to illuminate only the ink droplet deposited by the printhead ejector and be extinguished after it passes over the ink droplet; and wherein a ratio of the number of UV-LEDs in said plurality of UV-LEDs to the number of printhead ejectors in said plurality of printhead ejectors is 1.

8. The assembly of claim 7, wherein said assembly further comprises a first element and a second element;

said plurality of printhead ejectors are located upon said first element;

said plurality of UV-LEDs is located upon said second element; and the plurality of UV-LEDs comprises at least two UV-LEDs having different wavelengths.

9. The assembly of claim 7, wherein the assembly is additionally adapted to be attached to a carriage.

10. The assembly of claim 8, wherein said first element and said second element are rigidly interconnected.

11. The assembly of claim 7, wherein the UV-LED is adapted to be illuminated only when the UV-LED is directly over the ink droplet.

12. The assembly of claim 7, wherein the UV-LEDs are located in an oxygen-free zone of an associated printing area for curing of the ink droplet.

* * * * *